United States Patent [19]

Gavin

[11] 4,270,735

[45] Jun. 2, 1981

[54] ELECTRIFIED FENCE SWITCHING DEVICE

[75] Inventor: Bruce M. Gavin, 88 Joseph St., Invercargill, New Zealand

[73] Assignees: Bruce Malcolm Gavin; Nelson James Hubber, both of Invercargill, New Zealand

[21] Appl. No.: 88,104

[22] Filed: Oct. 24, 1979

[51] Int. Cl.[3] ..... H05C 1/00

[52] U.S. Cl. ..... 256/10; 307/132 E

[58] Field of Search ..... 256/10; 307/132 R, 132 E, 307/139, 143

[56] References Cited

U.S. PATENT DOCUMENTS

| | | | |
|---|---|---|---|
| 3,325,717 | 6/1967 | Nellis | 256/10 |
| 3,398,330 | 8/1968 | Poole | 307/132 E |
| 3,868,545 | 2/1975 | Caron | 256/10 X |

*Primary Examiner*—Peter P. Nerbun

[57] ABSTRACT

A switching device enabling an electric fence generator to be controlled by a D.C. pulse supplied to the fence from a separate handpiece. The handpiece comprises a battery with the negative terminal connected to an earth probe. D.C. voltage isolation means are provided between the fence and its generator. The fence is also connected via generator pulse restriction and reduction means to a D.C. detector feeding a multivibrator which via switches controls the main supply to the generator. A D.C. pulse is applied to a fence with the touching of the positive terminal of the handpiece thereto. Shorting of the control pulse to earth via the generator is prevented by the forward voltage factor of the isolation means. Thus, the control pulse triggers the detector to alter the state of the multivibrator and thus switch the generator ON and OFF as the case may be. A storage capacitor delays the state of the multivibrator in the case of inadvertent switching-off of the generator.

4 Claims, 1 Drawing Figure

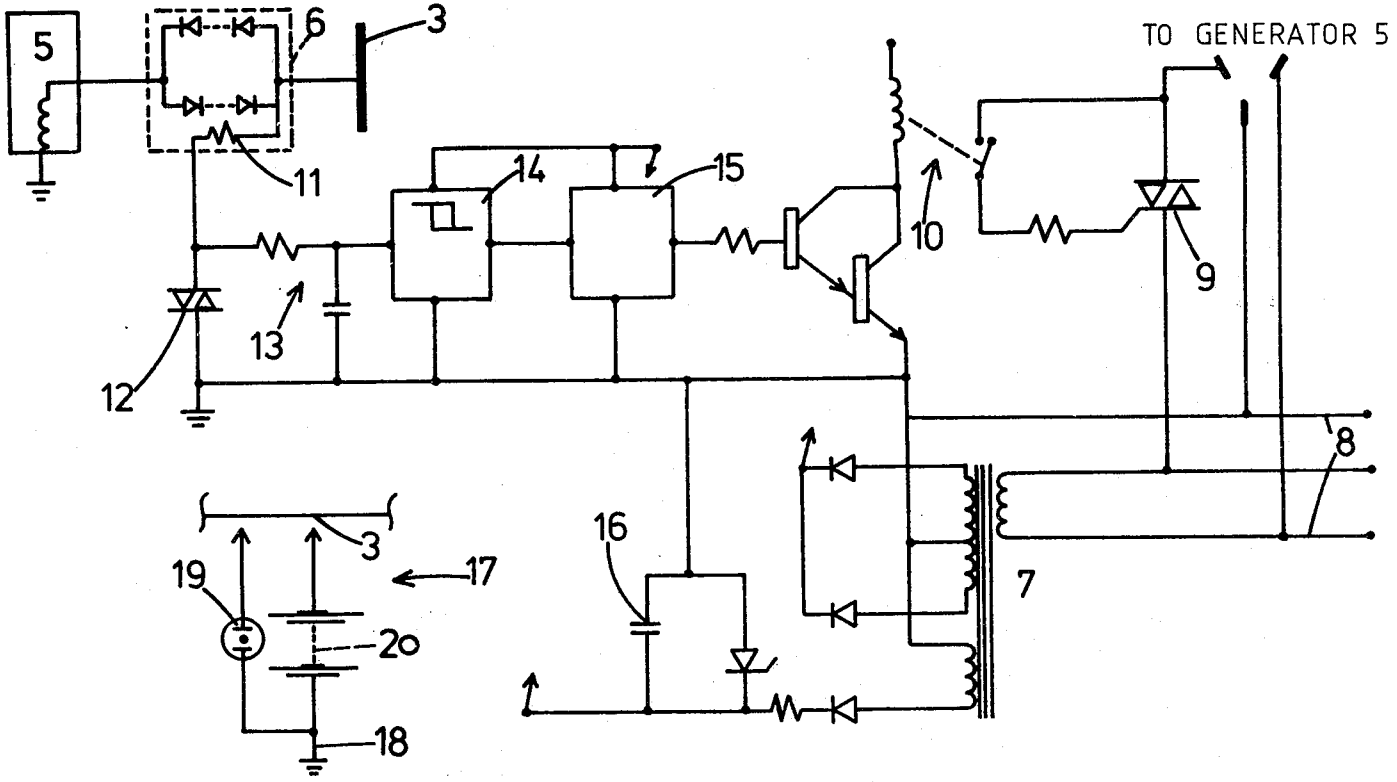
TO GENERATOR 5
8
9
7
10
15
16
14
17
3
20
18
6
11
13
19
12
5

ELECTRIFIED FENCE SWITCHING DEVICE

BACKGROUND OF THE INVENTION

This invention relates to electrified fences and is particularly concerned with a switching device enabling control of the fence generator from any position along the fence.

OBJECTS OF THE INVENTION

The object of this invention is to provide a switching device for an electrified fence enabling the pulse generator to be switched on and off from any point along the fence by the application of a control pulse thereto from a separate handpiece.

A further object of this invention is to provide a control pulse generating handpiece of simple construction and thus relatively cheap to produce. Thus it will be economical for a user to have more than one handpiece which will facilitate usage by a number of operators.

SUMMARY OF THE INVENTION

According to a first aspect of this invention there is provided an electrified fence generator switching device consisting of a D.C. pulse means physically separate from a switching circuit. The switching circuit comprises a D.C. detector feeding a bistable switch which controls a switching means control coupled to or adapted for control coupling to a generator of an electrified fence. The switching circuit incorporates a voltage integrator, an A.C. filter means and a D.C. voltage isolation means to isolate the generator from the fence when connected as aforesaid to the device.

According to a second aspect of this invention there is provided an electrified fence system comprising an electrically insulated fence, a generator coupled to the fence through D.C. isolation means, a switching circuit comprising a D.C. detector feeding a bistable switch circuit operating switching means which in turn controls the generator. A detector input circuit is coupled to the fence and incorporates a voltage integrator A.C. filter means. A physically separate D.C. pulse device is provided to energize the fence to trigger the switching circuit.

BRIEF DESCRIPTION OF THE DRAWINGS

The accompanying drawing is a composite circuit diagram of the switching device of the present invention as applied to a electrified fence generator, showing the handpiece depicted, partly schematically, as an isolated FIGURE in the lower left of the FIGURE.

DESCRIPTION OF THE PREFERRED EMBODIMENT

An electric fence pulse generator 5 is connected to an electrically insulated fence 3 through isolation means 6 described in more detail hereinafter. Isolation means 6 either physically forms part of the switching device or may be physically separate therefrom, in the latter case terminals are provided to enable the required connections be be made.

The switching device includes a power supply 7 to which is fed house voltage via lines 8, preferably tapped to provide a connection, such as a three pin socket, for coupling to and control of the generator 5 through switching means, as, for example, a triac 9 and an isolation switch, such as a reed relay 10. Alternatively switching can be made directly through the relay 10 so that the device can be utilized with separate generators. In a modified form the control means are an integral part of the generator and is wired accordingly.

The D.C. voltage isolation means 6, preferably comprises a diode array such as depicted or as an alternative (not shown) it may comprise a pair or pairs of zenner diodes arranged back to back. The fence side of the D.C. isolation means 6 is connected to earth via a resistor 11 and a diac 12, the diac effectively reducing the generator voltage pulses to manageable limits for filtering by an integrator filter circuit 13. As an alternative to diac 12, back to back zenner diodes can be used.

A schmidt trigger detector circuit 14 is provided for detecting any D.C. voltage on fence 3. The detector circuit 14 combines with an electrically operative bistable circuit, for example, a multivibrator 15 whereby the switching thereof controls the switching of relay 10 and triac 9 and thus the ON, OFF control of generator 5.

A storage capacitor 16 is preferably provided to enable multivibrator 15 to retain its state of any particular moment for approximately 30 minutes, this feature being considered desirable to compensate for power failures and other temporary switching-off of generator 5.

A physically separate D.C. pulse means 17 is provided to provide a control signal, when required, to the control means. The D.C. pulse means 17 preferably comprises a dry cell battery 20 having a negative ground probe 18. The positive terminal of the battery 20 can be touched with probe 18 grounded on the fence to provide a D.C. pulse thereon. Preferably a neon indicator lamp 19 is incorporated with the D.C. pulse device. The entire D.C. pulse means is preferably in the form of a handpiece, such that the state of the fence can be tested particularly before and after application of a D.C. pulse.

In operation the device is connected to an electrified fence as depicted in the circuit diagram and as described above. On application of a D.C. pulse to the fence 3 such as by use of the D.C. pulse means 17, its presence is detected by trigger 14, thus the state of multivibrator 15 is altered resulting in the switching OFF or ON, as the case may be, of generator 5. Another D.C. pulse to fence 3 will similarly change the state of multivibrator 15 resulting in the opposing switching, ON or OFF of, generator 5.

As will be evident from the circuit diagram use is made of the forward voltage factor of diodes to isolate the D.C. voltage signal pulse from the generator 5 which would otherwise short the D.C. voltage signal to earth. It will be appreciated that a similar effect can be obtained by utilising zenner diodes, an array of voltage dependent resisters or a capacitor as the isolation means 6.

I claim:

1. An electrified fence generator switching device comprising a physically separate D.C. pulse means and a switching circuit said switching circuit comprising a D.C. detector feeding a bistable switch circuit in parallel with a storage capacitor provided to temporarily maintain the state of the bistable circuit when the generator is switched OFF, said bistable switch circuit controlling a switching means control coupled to or adapted for control coupling to the generator, an input to the detector adapted for connection to the fence being coupled for electrification by the generator and incorporating a voltage integrator A.C. filter means and a D.C. voltage isolation means to isolate the generator from the fence when connected as aforesaid to the device.

2. A switching device as claimed in claim 1 wherein the D.C. pulse means comprises a dry cell battery and a probe for earthing the negative terminal thereof.

3. A switching device as claimed in claim 2 formed as a separate unit to an electrified fence generator and incorporating means by which such a generator can be coupled thereto.

4. A switching device as claimed in claim 2 wherein a neon indicator lamp is coupled between a free terminal and the negative terminal of the battery to form a unitary handpiece therewith.

* * * * *